US005221591A

United States Patent [19]

Bugner et al.

[11] Patent Number: 5,221,591

[45] Date of Patent: Jun. 22, 1993

[54] PHOTOELECTROGRAPHIC IMAGING WITH A MULTI-ACTIVE ELEMENT CONTAINING NEAR-INFRARED SENSITIZING PIGMENTS

[75] Inventors: Douglas E. Bugner; William Mey; George G. Fulmer; John W. May, all of Rochester, N.Y.

[73] Assignee: Eastman Kodak Company, Rochester, N.Y.

[21] Appl. No.: 767,759

[22] Filed: Sep. 30, 1991

Related U.S. Application Data

[63] Continuation-in-part of Ser. No. 712,799, Jun. 10, 1991, abandoned.

[51] Int. Cl.[5] ..... G03G 5/024; G03G 5/07

[52] U.S. Cl. ..... 430/58; 430/72

[58] Field of Search ..... 430/58, 59, 72

[56] References Cited

U.S. PATENT DOCUMENTS 3,997,342 12/1976 Bailey .
4,110,112 8/1978 Roman et al. .
4,111,693 9/1978 Wright et al. .
4,113,483 9/1978 Roman et al. .
4,175,960 11/1979 Berwick et al. .
4,444,860 4/1984 Yasujima et al. .
4,578,334 3/1986 Borsenberger et al. .

FOREIGN PATENT DOCUMENTS 56-017357-A 2/1981 Japan .
56-017358-A 2/1981 Japan .
60-221760-A 11/1985 Japan .

*Primary Examiner*—Marion E. McCamish
*Assistant Examiner*—S. Rosasco
*Attorney, Agent, or Firm*—Nixon, Hargrave, Devans & Doyle

[57] ABSTRACT

The present invention relates to a photoelectrographic element having a conductive layer in electrical contact with a acid photogenerating layer which is free of photopolymerizable materials and contains an acid photogenerator, a pigment which absorbs near-infrared radiation, and, preferably, an electrically insulating binder. Contiguous with the acid photogenerating layer is a charge transport layer formed from a polymeric binder and one or more charge transport materials. A process for forming images with this element is also disclosed.

31 Claims, 1 Drawing Sheet

PHOTOELECTROGRAPHIC IMAGING WITH A MULTI-ACTIVE ELEMENT CONTAINING NEAR-INFRARED SENSITIZING PIGMENTS

This is a continuation-in-part of U.S. patent application Ser. No. 712,799 filed Jun. 10, 1991, now abandoned.

FIELD OF THE INVENTION

This invention relates to photoelectrographic elements and an imaging method of exposing such elements with near-infrared radiation.

BACKGROUND OF THE INVENTION

Electrophotographic compositions and imaging processes are well known. In such processes, an electrophotographic element, having a photoconductive layer, is electrostatically charged and then imagewise exposed to form a latent electrostatic image. The latent electrostatic image is subsequently developed with a toner composition.

Various types of photoconductive insulating materials are known for use in electrophotographic imaging processes. In many conventional electrophotographic elements, the photoconductive insulating material is in a single layer composition affixed to a conductive support.

In addition, various multi-active electrophotographic elements (i.e. those having more than one active layer) have been described in the art. See e.g., U.S. Pat. No. 3,165,403 to Hoesterey. One layer, known as the charge generation layer, is affixed to the conductive support and generates charge carriers when exposed. Also present is a charge transport layer through which charge carriers which are generated in the adjacent charge generation layer pass in moving to the charged surface of the element.

Electrophotographic processes suffer from the deficiency of having to repeat the exposing step each time a copy is made. This is uneconomical and inefficient when producing multiple copies of a single document. As a result, photoelectrographic elements have been developed to produce multiple copies from a single exposure. See e.g., U.S. Pat. Nos. 4,661,429 and 3,681,066 as well as German Democratic Republic Patent No. 226,067 and Japanese Patent No. 105,260.

Acid photogenerators have been employed in photoelectrographic elements to be exposed with actinic or undefined radiation as shown, for example, in U.S. Pat. No. 3,316,088. Sensitizer dyes have been disclosed with regard to such elements, but not for sensitization in the near-IR portion of the spectrum. See, for example, in U.S. Pat. No. 3,525,612 and Japanese Patent No. 280,793.

SUMMARY OF THE INVENTION

The present invention relates to a photoelectrographic element comprising a conductive layer in electrical contact with a acid photogenerating layer or a charge transport layer. The acid photogenerating and charge transport layers are contiguous. The acid photogenerating layer is free of photopolymerizable materials and includes an acid photogenerator in accordance with U.S. Pat. No. 4,661,429, a pigment which absorbs near-infrared radiation, and, preferably, an electrically insulating binder.

The present invention also provides a photoelectrographic imaging method which utilizes the above-described photoelectrographic element. This process comprises the steps of: exposing the acid photogenerating layer imagewise to actinic radiation without prior charging to create a latent conductivity pattern and printing by a sequence comprising: charging to create an electrostatic latent image, developing the electrostatic latent image with charged toner particles, transferring the toned image to a suitable receiver, and cleaning any residual, untransferred toner from the photoelectrographic element.

The imaging method and elements of the present invention use acid photogenerators in a thin acid photogenerating layer coated over a conductive layer to form images. This imaging technique or method takes advantage of the discovery that exposure of the acid photogenerator significantly increases the conductivity in the exposed area of the layer. Imagewise irradiation of the acid photogenerator layer creates a persistent differential conductivity between exposed and unexposed areas. This allows for the subsequent use of the element for printing multiple copies from a single exposure with only multiple charging, developing, transferring, and cleaning steps. This is different from electrophotographic imaging techniques where the electrophotographic element must generally be charged electrostatically followed by imagewise exposure for each copy produced. As a result, maximum throughput tends to be limited, and energy consumption is likely to be greater.

The charged toner may have the same sign as the electrophotographic latent image or the opposite sign. In the former case, a negative image is developed, while a positive image is developed in the latter.

By incorporating a pigment which absorbs near-infrared radiation in the acid photogenerating layer of the photoelectrographic element, such elements are no longer limited to exposure with ultraviolet and visible radiation. Such pigments instead permit exposure with radiation in the near-infrared region of the spectrum (having wavelengths of 700 to 1,000 nm). Nevertheless, these pigments also have the ability to absorb near-ultraviolet radiation (having a wavelength of 250 to 450 nm), thereby permitting exposure with a conventional U.V. radiation source or with a laser diode which emits radiation in the near-infrared part of the spectrum. The use of laser diodes is particularly advantageous, because they are relatively inexpensive and consume little energy. Certain copper (II) salts, which are known to catalyze the thermal decomposition of iodonium salts especially when used in conjunction with compounds containing secondary hydroxyl groups, may also be included in the acid photogenerating layer.

The charge transport layer contains a polymeric binder and one or more charge transport materials.

This arrangement permits the element to be exposed with near-infrared radiation and charged with negative polarity. In addition, the element's performance is unexpectedly less sensitive to the type and nature of the pigment compared to elements without a charge transport layer. Another improvement over such elements is that a higher degree of discharge is achieved in exposed portions of the charged element. A further advantage over a single layer element is that the element of the present invention may be charged with either negative or positive polarity when near ultraviolet radiation is used for exposure.

DETAILED DESCRIPTION OF THE DRAWING AND INVENTION

Figure 1:
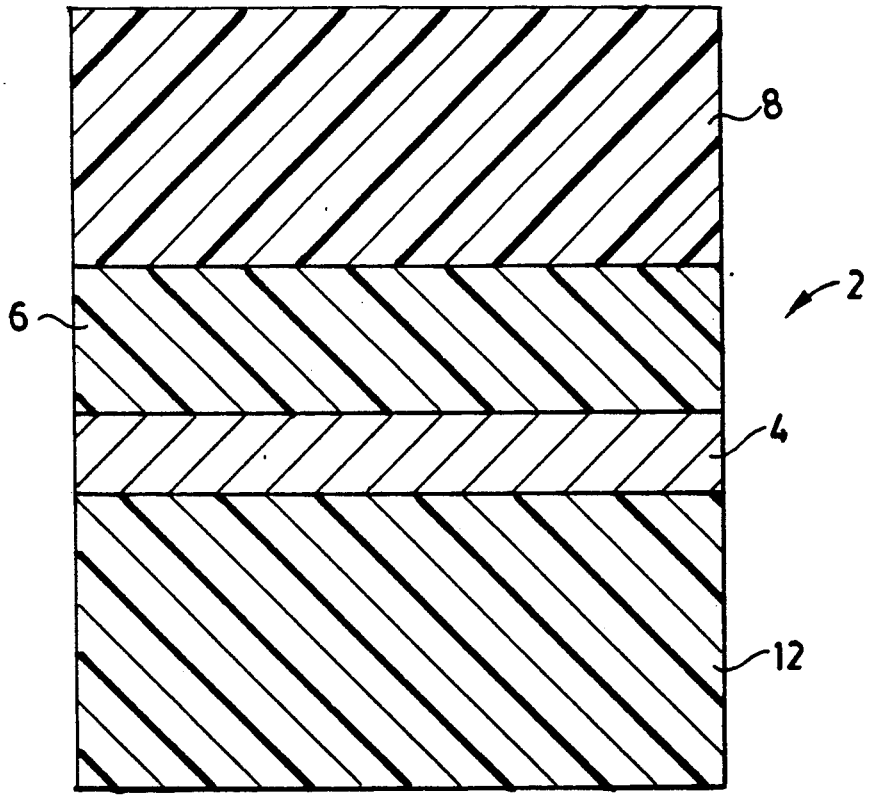
FIG. 1 is a side, cross-sectional view of a photoelectrographic element in accordance with the present invention.

FIG. 1 shows a side, cross-sectional view of a photoelectrographic element 2 in accordance with the present invention. Element 2 comprises conductive layer 4 in electrical contact with acid photogenerating layer 6 which is free of photopolymerizable materials and includes a pigment which absorbs near-infrared radiation, an acid photogenerator, and, preferably, an electrically insulating binder. Contiguous with acid photogenerating layer 6 is charge transport layer 8 formed from a polymeric binder and one or more charge transport materials. An optional barrier or subbing layer can be positioned between conductive layer 4 and acid photogenerating layer 6. Conductive layer 4 is positioned on polyester base 12. In an alternate embodiment, layers 6 and 8 can be reversed so that charge transport layer 8 is in electrical contact with conductive layer 4.

In preparing the acid photogenerating layer, the acid photogenerator and an electrically insulating binder are dissolved in a suitable solvent. To the resulting solution, a dispersion of pigment in the same or different solvent is added.

Solvents of choice for preparing acid photogenerating layer coatings include a number of solvents including aromatic hydrocarbons such as toluene; ketones, such as acetone or 2-butanone; esters, such as ethyl acetate or methyl acetate; chlorinated hydrocarbons such as ethylene dichloride, trichloroethane, and dichloromethane; ethers such as tetrahydrofuran; or mixtures of these solvents.

The acid photogenerating layer is coated on a conductive layer in any well-known manner such as by doctor-blade coating, spin coating, dip-coating, machine coating, and the like.

The acid photogenerating materials should be selected to impart little or no conductivity before irradiation with the conductivity level increasing after exposure. Useful results are obtained when the coated layer contains at least about 1 weight percent of the acid photogenerator. The upper limit of acid photogenerator is not critical as long as no deleterious effect on the initial conductivity of the film is encountered. Usually, the upper limit is 50 weight percent. A preferred weight range for the acid photogenerator in the coated and dried composition is from 15 weight percent to about 30 weight percent.

The thicknesses of the acid photogenerating layer can vary widely with dry coating thicknesses ranging from about 1 μm to about 30 μm, preferably 1 μm to 5 μm. Coating thicknesses outside these ranges may also be useful.

Potentially useful aromatic onium salt acid photogenerators are disclosed in U.S. Pat. Nos. 4,661,429, 4,081,276, 4,529,490, 4,216,288, 4,058,401, 4,069,055, 3,981,897, and 2,807,648 which are hereby incorporated by reference. Such aromatic onium salts include Group Va, Group VIa, and Group VIIa elements. The ability of triarylselenonium salts, aryldiazonium salts, and triarylsulfonium salts to produce protons upon exposure to ultraviolet and visible light is also described in detail in "UV Curing, Science and Technology", Technology Marketing Corporation, Publishing Division, 1978.

A representative portion of useful Group Va onium salts are:

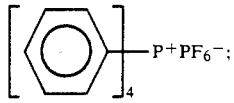

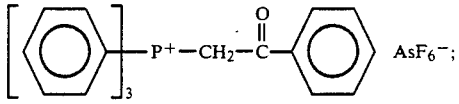

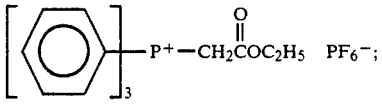

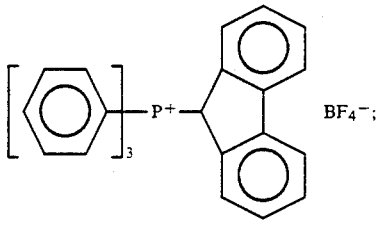

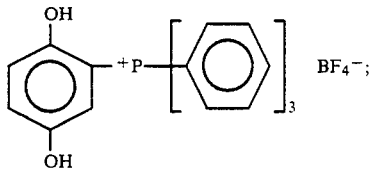

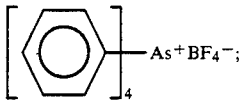

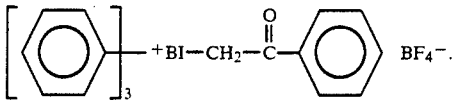

A representative portion of useful Group VIa onium salts, including sulfonium and selenonium salts, are:

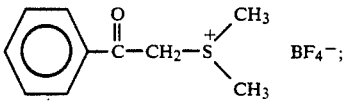

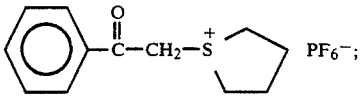

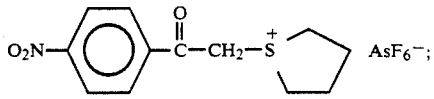

-continued
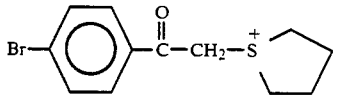
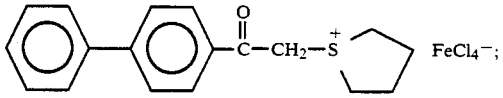
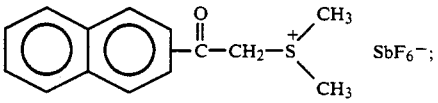
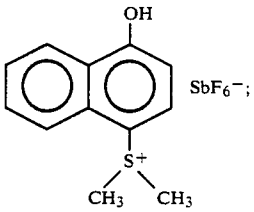
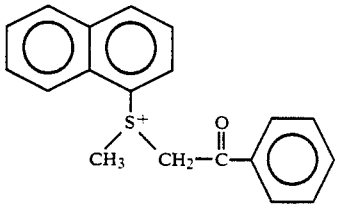
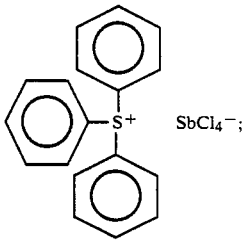
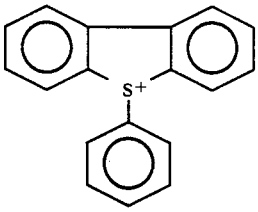
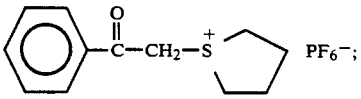
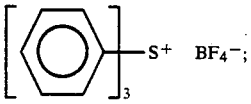
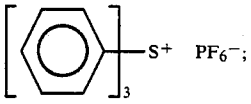
-continued
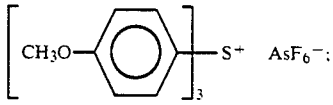
and
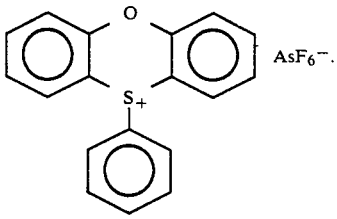
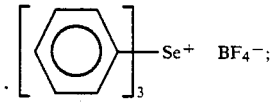
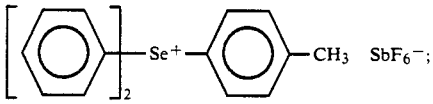
and
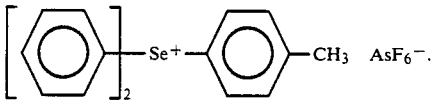
A representative portion of the useful Group VIIa onium salts, including iodonium salts, are the following:
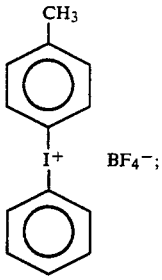
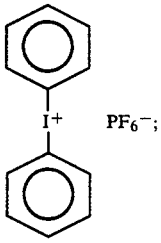

-continued

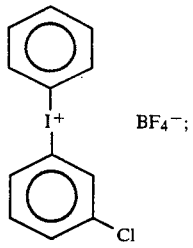

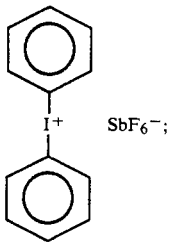

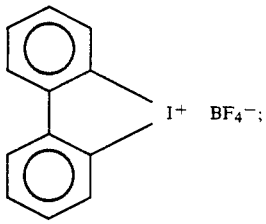

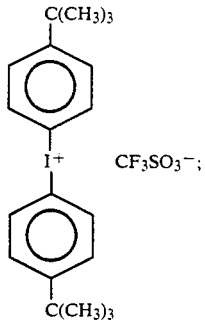

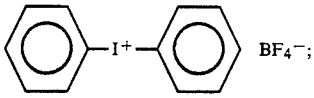

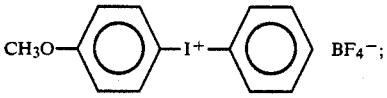

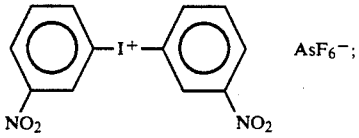

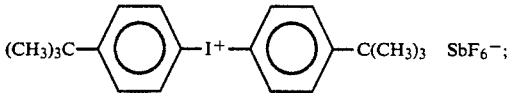

-continued

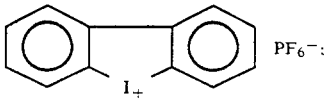

and

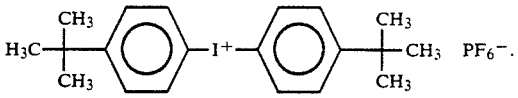

Also useful as acid photogenerating compounds are:

1. Aryldiazonium salts such as disclosed in U.S. Pat. Nos. 3,205,157; 3,711,396; 3,816,281; 3,817,840 and 3,829,369. The following salts are representative:

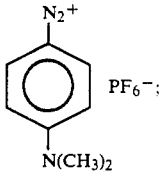

and

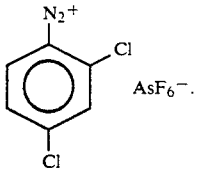

2. 6-Substituted-2,4-bis(trichloromethyl)-5-triazines such as disclosed in British Patent No. 1,388,492. The following compounds are representative:

| | R |
|---|---|
| 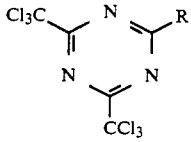 | 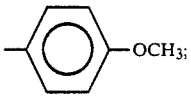 |
| | 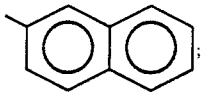 |
| | 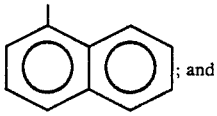 |
| | 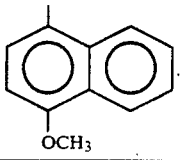 |

A particularly preferred class of acid photogenerators are the diaryl iodonium salts, especially di-(4-t-butylphenyl)iodonium trifluoromethanesulfonate ("ITF").

Useful electrically insulating binders for the acid photogenerating layer include polycarbonates, polyesters, polyolefins, phenolic resins, and the like. Desirably, the binders are film forming. Such polymers should be capable of supporting an electric field in excess of $1\times10^5$ V/cm (preferably $1\times10^6$ V/cm) and should not inject charge into the charge transport layer in unexposed areas.

Preferred binders are styrene-butadiene copolymers; silicone resins; styrene-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc.; polystyrene; nitrated polystyrene; poly(vinylphenol); polymethylstyrene; isobutylene polymers; polyesters, such as phenol formaldehyde resins; ketone resins; polyamides; polycarbonates; etc. Methods of making resins of this type have been described in the prior art, for example, styrene-alkyd resins can be prepared according to the method described in U.S. Pat. Nos. 2,361,019 and 2,258,423. Suitable resins of the type contemplated for use in the acid photogenerating layer of this invention are sold under such tradenames as Vitel PE 101-X, Cymac, Piccopale 100, Saran F-220. Other types of binders which can be used include materials such as paraffin, mineral waxes, etc. Particularly preferred binders are aromatic esters of polyvinyl alcohol polymers and copolymers, as disclosed in pending U.S. patent application Ser. No. 509,119, entitled "Photoelectrographic Elements". One example of such a Polymer is poly (vinyl benzoate-co-vinyl acetate) ("PVBZ").

The binder is present in the dried acid photogenerating layer in a concentration of 30 to 98 weight %, preferably 55 to 70 weight %.

The pigment which absorbs near-infrared radiation can be any such material possessing this property but must not adversely interfere with the operation of the acid photogenerator. The use of such pigments is disclosed in copending U.S. patent application Ser. No. 632,258, filed Dec. 21, 1990, and entitled "Photoelectrographic Imaging With Near-Infrared Sensitizing Pigments." Also on file is copending U.S. application Ser. No. 632,304, filed Dec. 21, 1990, and entitled "Photoelectrographic Imaging With Near-Infrared Sensitizing Dyes."

Suitable pigments include those selected from the phthalocyanine pigment family. Particularly useful phthalocyanine pigments include:

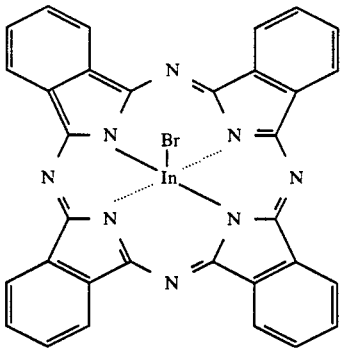

bromoindium phthalocyanine ("BrInPc")

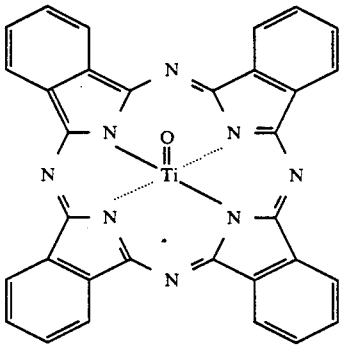

titanyl phthalocyanine ("TiOPc")

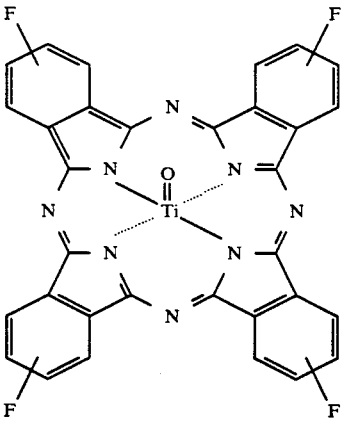

tetrafluoro-phthalocyanine ("TiOPcF4")

Use of these pigments in photoelectrographic elements is particularly advantageous, because they not only absorb near-infrared radiation (i.e. 600 to 900 nm) which can be produced by laser diodes, but they also absorb near-ultraviolet radiation (i.e. 250 to 450 nm) produced by conventional sources of exposure. As a result, these photoelectrographic elements have great flexibility. Typically, near-infrared radiation absorptive pigments are included in the photoelectrographic element of the present invention at concentrations 1 to 20 weight %, preferably 5 to 15 weight %, of the dried acid photogenerating layer.

When the acid photogenerating layer contains iodonium salts, it may be advantageous to include in that layer a compound with secondary hydroxyl groups and a copper (II) salt which, when used together, are known to catalyze thermal decomposition of iodonium salts. Suitable copper (II) salts are disclosed by J. V. Crivello, T. P. Lockhart, and J. L. Lee, *J. Polym. Sci.. Polym. Chem. Ed* , 21, 97 (1983). These include copper (II) arylates, copper (II) alkanoates, copper (II) acetonates, copper (II) acetoacetates, and mixtures thereof.

A particularly preferred example of a copper (II) salt useful for this invention is copper (II) ethyl acetoacetate. This salt is soluble in organic solvents such as dichloromethane and can be homogeneously incorporated at concentrations as high as 18% by weight of the dry photoelectrographic element.

The compound with secondary hydroxyl groups includes those which contain dialkyl-, diaryl-, alkylaryl-, and hydroxymethane moieties. A particularly preferred compound with secondary hydroxyl groups is the binder polymer having the following formula:

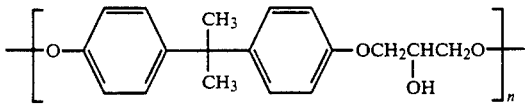

This is a copolymer of bisphenol A and epichlorohydrin, and may be obtained from Aldrich Chemical Company, Milwaukee, Wis. under the trade name PHENOXY RESIN.

If a copper (II) salt and a compound with secondary hydroxyl groups are included in the acid photogenerating layer, the copper (II) salt is present in an amount of 1 to 20, preferably 10–15, weight percent and, except when PHENOXY RESIN is used, the compound with secondary hydroxyl groups is present in an amount of 1 to 10, preferably 2–4, weight percent. Of course, when a copper (II) salt and a compound with secondary hydroxyl groups are included in the acid photogenerating layer, the range of binder concentration must be adjusted accordingly. When PHENOXY RESIN is used as the compound with secondary hydroxyl groups, it is also functioning as the binder and then is used, in a concentration of 10–97 weight %, preferably 40 to 70 weight %.

Useful conductive layers include any of the electrically conducting layers and supports used in electrophotography. These include, for example, paper (at a relative humidity above about 20 percent); aluminum paper laminates; metal foils, such as aluminum foil, zinc foil, etc.; metal plates, such as aluminum, copper, zinc, brass, and galvanized plates; regenerated cellulose and cellulose derivatives; certain polyesters, especially polyesters having a thin electroconductive layer (e.g., cuprous iodide) coated thereon; etc. Especially useful is a conductive support consisting of a flexible polyester base 4–7 mils thick and a submicron layer of cuprous iodide dispersed in poly(vinyl formal).

While the acid photogenerating layer of the present invention can be affixed, if desired, directly to a conductive layer, it may be desirable to use one or more intermediate barrier or subbing layers between the conductive layer and the acid photogenerating layer to improve adhesion to the conductive layer and/or to act as an electrical and/or chemical barrier between the acid photogenerating layer and the conductive layer.

Such subbing layers, if used, typically have a dry thickness in the range of about 0.1 to about 5 μm, preferably 0.5 to 2 μm. Useful subbing layer materials include film-forming polymers such as cellulose nitrate, polyesters, copolymers or poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Other useful subbing materials include the so-called tergels which are described in Nadeau et al, U.S. Pat. No. 3,501,301. Cellulose nitrate has been found to be a particularly effective subbing layer.

The charge transport layer can be formed from any charge transport material used in multi-active, electrophotographic elements. Such materials generally include a polymeric binder which can be applied as a coating and will adhere to the remainder of the element as a smooth, clean, wear resistant surface.

Suitable binders for use in the charge-transport layer are film-forming polymeric materials having a fairly high dielectric strength and good electrically insulating properties. The binders optionally utilized in the acid photogenerating layer are also suitable for use in the charge transport layer. Other useful charge transport binder polymers include: polyvinyl toluene-styrene copolymers; vinylidene chloride-vinyl chloride copolymers; polymethylstyrene; polyesters, such as poly[ethylene-co-isopropylidene-2,2-bis(ethyleneoxyphenylene)-terephthalate]; polythiocarbonates; copolymers of vinyl arylates and vinyl acetate such as poly(vinyl-m-bromobenzoate-co-vinyl acetate); chlorinated poly(olefins), such as chlorinated poly(ethylene); etc.

In general, it has been found that polymers containing aromatic or heteroaromatic groups are most effective as charge-transport layer binders. These polymers, by virtue of their heteroaromatic or aromatic groups, tend to provide little or no interference with the transport of charge carriers through the layer. Heteroaromatic or aromatic-containing polymers which are especially useful for bipolar charge transport include styrene-containing polymers, bisphenol-A-polycarbonate polymers, phenol formaldehyde resins, polyesters such as poly-[ethylene-co-isopropylidene-2,2-bis(ethyleneoxy-phenylene)]terephthalate, and copolymers of vinylarylates and vinylacetate such as poly (vinyl-m-bromobenzoate-co-vinyl acetate).

Although the charge transport mechanism is not fully understood, various known charge transport materials may be used in the charge transport layer. For example, representative of n-type transport materials are disclosed in U.S. Pat. Nos. 4,277,551, 4,609,602, 4,719,163, 4,948,911, 4,175,960, 4,514,481, 4,474,865, 4,546,059, 4,869,984, 4,869,985, 4,909,966, 4,913,996, and 4,921,637. Representative p-type charge-transport materials include carbazole materials, arylamine-containing materials, polyarylalkane materials, and strong Lewis base materials. These and other illustrative p-type charge-transport materials are disclosed in U.S. Pat. No. 4,719,163 to Staudenmayer et al.

An especially preferred charge-transporting layer is formed from a solid solution comprising 40 parts by weight of a mixture of tri-p-tolylamine ("TTA"), 1,1-bis-[(N,N-di-4-tolyl)-4-aminophenyl]cyclohexane ("BDTAPC"), and diphenylbis-(N,N-di-ethyl-4-aminophenyl)methane ("DPBAPM") in 60 parts by weight of a polyester binder ("PE") comprising terephthalic acid, azelaic acid, and (2-norbornylidene)bisphenol, in a molar ratio of 20:30:50, respectively. The thickness of the charge transport layer may range from 1 to about 30 μm, preferably 5 to 30 μm.

The charge-transport layer may also contain other addenda such as leveling agents, surfactants, plasticizers, and the like to enhance various physical properties of the layer. In addition, various addenda to modify the electrophotographic response of the element may be incorporated in the charge-transport layer.

The charge transport layer can be prepared by any of several well known coating methods, including doctor-blade coating, spin coating, dip-coating, machine coating, and the like.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art and accordingly an extended discussion thereof is unnecessary. Several such overcoats are described, for example, in *Research Disclosure*. "Electrophotographic Elements, Materials, and Processes", Vol. 109, page 63, Paragraph V, May, 1973, which is incorporated herein by reference.

The photoelectrographic elements of the present invention are employed in the photoelectrographic process summarized above. This process involves a 2-step sequence—i.e. an exposing phase followed by a printing phase.

In the exposing phase, the acid photogenerating layer is exposed imagewise to near-infrared or near ultraviolet radiation without prior charging to create a latent conductivity pattern. Once the exposing phase is completed, a persistent latent conductivity pattern exists on the element, and no further exposure is needed. The element can then be subjected to the printing phase either immediately or after some period of time has passed.

The element is given a blanket electrostatic charge, for example, by passing it under a corona discharge device, which uniformly charges the surface of the acid photogenerating layer. The charge is dissipated by the charge transport layer in the exposed areas, creating an electrostatic latent image. The electrostatic latent image is developed with charged toner particles, and the toned image is transferred to a suitable receiver (e.g., paper). The toner particles can be fused either to a material (e.g., paper) on which prints are actually made or to an element to create an optical master or a transparency for overhead projection. Any residual, untransferred toner is then cleaned away from the photoelectrographic element.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

By the above-described process, multiple prints from a single exposure can be prepared by subjecting the photoelectrographic element only once to the exposing phase and then subjecting the element to the printing phase once for each print made.

The photoelectrographic element can be developed with a charged toner having the same polarity as the latent electrostatic image or with a charged toner having a different polarity from the latent electrostatic image. In one case, a positive image is formed. In the other case, a negative image is formed. Alternatively, with near-ultraviolet radiation exposure, the photoelectrographic element can be charged either positively or negatively, and the resulting electrostatic latent images can be developed with a toner of given polarity to yield either a positive or negative reproduction of the original.

The photoelectrographic element of the present invention can be imaged with a laser, which emits radiation most efficiently at near-infrared wavelengths. For example, a laser diode with about 200 mW peak power output at 827 nm and a spot size of about 30 μm can be used to image the photoelectrographic element. In a typical device, the element is mounted on a rotating drum, and the laser is stepped across the length of the drum in lines about 20 μm from center to center. The image is written by modulating the output of the laser in an imagewise manner. When photoelectrographic elements of the present invention are imaged in this manner, an imagewise conductivity pattern is formed from which toned images can be produced, as described above.

Alternatively, the photoelectrographic element can be exposed with near-ultraviolet radiation from a conventional source of such radiation. The pigments of the present invention are able to sensitize the element to such radiation.

In an alternate embodiment, the photoelectrographic element of the present invention can also be used as an electrophotographic element, as described above in the Summary of the Invention section. This has the added advantage of permitting differential annotation of each image produced during the printing phase. For example, address information can be varied from one print to the next.

EXAMPLES

In the examples which follow, the preparation of representative materials, the formulation of representative film packages, and the characterization of these films are described. These examples are provided to illustrate the usefulness of the photoelectrographic element of the present invention and are by no means intended to exclude the use of other elements which fall within the above disclosure.

The coatings described below were prepared by machine coating techniques. The support comprises a flexible polyester base which is overcoated with (a) cuprous iodide (3.4 wt. %) and poly(vinyl formal) (0.32 wt. %) in acetonitrile (96.3 wt. %), and (b) cellulose nitrate (6 wt. %) in 2-butanone (94 wt. %) over (a). Machine coating was carried out by pumping the experimental solutions through an extrusion hopper onto a moving support. Dried film thicknesses between 1 and 3 μm for the acid photogenerating layer and between 7 and 12 μm for the charge transport layer, were achieved by appropriate choice of pump speeds and moving support speeds.

The sensitivity of the coatings to near-IR exposure was evaluated by exposing the film on a breadboard equipped with a 200 mW IR laser diode (827 nm output), and the output beam focused to a 30 μm spot. The breadboard consists of a rotating drum, upon which the film is mounted, and a translation stage which moves the laser beam along the drum length. The drum rotation, the laser beam location, and the laser beam intensity are all computer controlled. The drum was rotated at a speed of 120 rpm, and the film was exposed to an electronically generated continuous tone step-wedge consisting of 11 exposure steps. The line spacing (distance between scan lines in the continuous tone step-wedge) was 20 μm, and the maximum intensity was about 100 mW with an exposure time of about 30 μsec/-pixel. Within one-half hour after exposure, the sample was mounted and tested on a separate linear breadboard. The sample was corona charged with a grid controlled charger set at a grid potential of either −500 V or +500 V. The surface potential, as listed in Table 1, was then measured at 1 sec after charging.

The near-UV sensitivity was measured by the following procedure. Each film sample was partially exposed with light from a 500 watt mercury arc lamp so that the total exposure was 3 joules per square centimeter. The sample was then evaluated by mounting it in electrical contact with a metal drum, and rotating the drum past a corona charger and an electrostatic voltmeter. The configuration is such that a given area of the film passes in front of the charger and voltmeter once every second, with the time between the charger and voltmeter being about 200 milliseconds. The grid potential on the charger is set at either −700 volts or +700 volts, with 0.40 ma current. The voltmeter measures the surface potential on both the exposed and unexposed regions of the film each cycle. After several cycles, both exposed and unexposed regions of the film reach equilibrium potentials.

When measuring either IR or UV sensitivity, the potential in an unexposed region is termed $V_{max}$ and the potential in a maximally exposed region is termed $V_{min}$. The difference between $V_{max}$ and $V_{min}$ is called δ V which represents the potential available for development. Since $V_{max}$ varies with relative humidity ("RH"), film thickness, and specific formulation and since δV is a function of $V_{max}$, it is difficult to compare δV's by themselves from one measurement to the next. However, the degree of discharge (hereafter "Fm"), i.e., the ratio of δV to $V_{max}$, is independent of $V_{max}$ in the range of 400 to 800 volts. Therefore, for the purpose of comparing the photoelectrographic behavior of the various inventive formulations, the values of $V_{max}$ and Fm will be used. Ideally, Fm should not change in response to changes in RH, but should remain constant.

Conventional photoconductivity measurements were performed on samples which had been charged to ca. −475 V with a corona discharge device. Low intensity light (ca. 5 erg/cm²-sec) which had been passed through a monochromator set at 830 nm was used to discharge the film. The film speed is given as the amount of light energy per unit area required to discharge the film to 80% of the initial voltage.

EXAMPLE 1

A acid photogenerating layer solution comprising 1.56 wt. % ITF, 3.9 wt. % $TiOPcF_4$, and 2.34 wt. % PVBZ in 92.2 wt. % dichloromethane ("DCM") was machine coated over the support described above. The dried acid photogenerating layer was overcoated with a charge transport layer solution comprising 2.15 wt. % TTA, 2.17 wt. % BDTAPC, 0.083 wt. % DPBAPM, and 6.6 wt. % PE in 89.0 wt. % DCM. The thickness of the acid photogenerating layer was found to be 1.0 μm, and the charge transport layer was 8.6 μm, as determined by photomicroscopy at 2500× of a cross-section. Additional pertinent data for this film are summarized below in Table 1.

EXAMPLE 2

A two-layer film was coated exactly as described in Example 1, except that the thickness of the acid photogenerating layer was 1.7 μm, and the charge transport layer was 7.4 μm. Data for this film is set forth in Table 1.

EXAMPLE 3

A two-layer film was coated exactly as described in Example 1, except that the thicknesses of the acid photogenerating layer and the charge transport layer were 1.6 and 11.6 μm, respectively. Data for this film is in Table 1.

A sample of this film was evaluated for conventional photoconductivity. The sample was charged to −500 V, allowed to dark decay to −475 V, and then was irradiated at 830 nm (5 erg/cm²-sec). The dark decay was 25 V/s, the energy required to discharge to −95 V (80% discharge) was 17 erg/cm², and the residual voltage on the film was −40 V.

EXAMPLE 4

A two-layer film was coated exactly as described in Example 1, except that BrInPc was used in place of $TiOPcF_4$, and the thicknesses of the acid photogenerating layer and the charge transport layer were 2.0 and 7.5 microns, respectively. Pertinent data for this film is summarized in the accompanying Table.

EXAMPLE 5

Using the same lots of ITf, $TiOPcF_4$, and PVBz as in Examples 1-3, a 6.8 μm, single-layer element comprising 22.5 wt. % ITF, 12.5 wt. % $TiOPcF_4$, and 65 wt. % PVBz was machine coated. Pertinent data is summarized in Table 1.

EXAMPLE 6

Using the same lots of ITf, BrInPc, and PVBz as in Examples 1-3, a 6.8 μm, single-layer element comprising 22.5 wt. % ITF, 12.5 wt. % BrInPc, and 65 wt. % PVBz was machine-coated. Pertinent data is set forth in TABLE 1.

TABLE 1

| | POSITIVE CHARGING | | | | NEGATIVE CHARGING | | | |
|---|---|---|---|---|---|---|---|---|
| | UV | | IR | | UV | | IR | |
| EXAMPLE | Vmax | Fm | Vmax | Fm | Vmax | Fm | Vmax | Fm |
| 1 | +967 V | 0.86 | +591 V | 0.02 | −532 V | 0.71 | −498 V | 0.80 |
| 2 | +842 | 0.88 | +582 | 0.02 | −534 | 0.66 | −489 | 0.80 |
| 3 | +840 | 0.83 | +600 | 0.02 | −556 | 0.62 | −560 | 0.69 |
| 4 | +870 | 0.87 | +589 | 0.03 | −515 | 0.70 | −467 | 0.63 |
| 5 | +423 | 0.41 | +547 | 0.78 | −653 | 0.04 | −564 | 0.16 |

TABLE 1-continued

| | POSITIVE CHARGING | | | | NEGATIVE CHARGING | | | |
|---|---|---|---|---|---|---|---|---|
| | UV | | IR | | UV | | IR | |
| EXAMPLE | Vmax | Fm | Vmax | Fm | Vmax | Fm | Vmax | Fm |
| 6 | +505 | 0.71 | +531 | 0.75 | −597 | 0.11 | −526 | 0.48 |

The results in Table 1 show that, in the case of near-infrared radiation exposure, the multiactive element of the present invention is complementary to comparative Examples 5–6 which have a single layer. Specifically, the multiactive element functions especially well upon charging with a negative polarity, whereas the single layer element functions best upon positive charging. Table 1 also shows that, for near ultraviolet radiation exposure, the multiactive element exhibits acceptable performance upon charging with either polarity. Table 1 further demonstrates (by comparing Examples 2 and 4 with Examples 5–6) that, with either near-ultraviolet or near-infrared radiation exposure, the multiactive element is less sensitive to the different pigments than the comparative single layer elements.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A photoelectrographic element for electrostatic imaging comprising:

a acid photogenerating layer free of photopolymerizable materials and comprising:

an acid photogenerator and a pigment which absorbs near-infrared radiation to sensitize said element to exposure with near-infrared radiation;

a charge transport layer contiguous with said acid photogenerating layer and comprising one or more charge transport materials; and a conductive layer in electrical contact with said acid photogenerating layer or said charge transport layer.

2. A photoelectrographic element according to claim 1, wherein the acid photogenerator is selected from the group consisting of 6-substituted-2,4-bis(trichloromethyl)-5-triazines, aromatic onium salts containing elements selected from the group consisting of Group Va, Group VIa, and Group VIIa elements, and diazonium salts.

3. A photoelectrographic element according to claim 2, wherein the acid photogenerator is an aromatic onium salt selected from the group consisting of aryl halonium salts, aryl phosphonium salts, aryl arsenonium salts, aryl sulfonium salts, aryl selenonium salts, aryl diazonium salts, and mixtures thereof.

4. A photoelectrographic element according to claim 3, wherein the acid photogenerator is di-(4-t-butylphenyl)iodonium trifluoromethanesulfonate).

5. A photoelectrographic element according to claim 1, wherein said acid photogenerating layer further comprises:

a binder selected from the group consisting of polycarbonates, polyesters, polyolefins, phenolic resins, paraffins, mineral waxes, and an aromatic ester of a polyvinyl alcohol polymer.

6. A photoelectrographic element according to claim 1, wherein the pigment is a phthalocyanine pigment.

7. A photoelectrographic element according to claim 6, wherein the pigment is selected from the group consisting of bromoindium phthalocyanine, titanyl phthalocyanine, and tetrafluorophthalocyanine.

8. A photoelectrographic element according to claim 1, wherein the acid photogenerating layer further comprises:

a copper (II) salt and a compound containing secondary hydroxyl groups.

9. A photoelectrographic element according to claim 8, wherein the copper (II) salt is selected from the group consisting of copper (II) arylates, copper (II) alkanoates, copper (II) acetonates, copper (II) acetoacetates, and mixtures thereof, and the compound containing secondary hydroxyl groups has the formula:

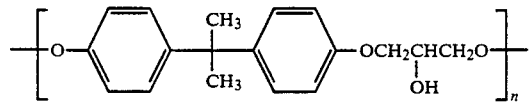

10. A Photoelectrographic element according to claim 1, where the pigment absorbs near-ultraviolet radiation, thereby sensitizing said photoelectrographic element to exposure with either near-infrared radiation or near-ultraviolet radiation.

11. A photoelectrographic element according to claim 1, wherein said charge transport layer further comprises:

a polymer containing heteroaromatic or heterocyclic groups.

12. A photoelectrographic element according to claim 1, wherein the one or more charge transport materials includes an electron transport material.

13. A photoelectrographic element according to claim 1, wherein the one or more charge transport materials includes a hole transport material.

14. A photoelectrographic element according to claim 1, wherein the one or more charge transport materials is capable of transporting both electrons and holes.

15. A photoelectrographic element according to claim 1 further comprising:

a barrier layer between said acid photogenerating layer and said conductive layer.

16. A photoelectrographic element for electrostatic imaging comprising:

a acid photogenerating layer free of photopolymerizable materials and comprising:

an acid photogenerator selected from the group consisting of aryl halonium salts, aryl phosphonium salts, aryl arsenonium salts, aryl sulfonium salts, triaryl selenonium salts, aryl diazonium salts, and mixtures thereof;

a phthalocyanine pigment which absorbs near-infrared radiation to sensitize said element to exposure with near-infrared radiation; and an electrically insulating binder selected from the group consisting of polycarbonates, polyesters, polyolefins, phenolic resins, paraffins, and mineral waxes;

a charge transport layer contiguous with said acid photogenerating layer and comprising one or more charge transport materials and a polymeric binder which is a polymer containing aromatic or heterocyclic groups; and a conductive layer in electrical communication with said acid photogenerating layer.

17. A photoelectrographic process for printing using a photoelectrographic element comprising:

a acid photogenerating layer free of photopolymerizable materials and comprising:

an acid photogenerator and a pigment which absorbs near-infrared radiation;

a charge transport layer contiguous with said acid photogenerating layer and comprising one or more charge transport materials; and a conductive layer in electrical contact with said acid photogenerating layer or said charge transport layer, said process comprising:

exposing said acid photogenerating layer imagewise to near-infrared radiation or near-ultraviolet radiation without prior charging to create a permanent latent conductivity pattern and printing an image from the latent conductivity pattern, said printing comprising:

charging said element having a permanent latent conductivity pattern to create an electrostatic latent image;

developing the electrostatic latent image by applying charged toner particles to said element to produce a toned image; and transferring the toned image to a suitable receiver, wherein said printing is carried out one time for each print made.

18. A process according to claim 17, wherein the acid photogenerator is an aromatic onium salt selected from the group consisting of aryl halonium salts, aryl phosphonium salts, aryl arsenonium salts, aryl sulfonium salts, aryl selenonium salts, aryl diazonium salts, and mixtures thereof.

19. A process according to claim 18, wherein the acid photogenerator is di-(4-t-butylphenyl)iodonium trifluoromethanesulfonate.

20. A process according to claim 17, wherein said acid photogenerating layer further comprises:

a binder selected from the group consisting of polycarbonates, polyesters, polyolefins, phenolic resins, paraffins, mineral waxes, and an aromatic ester of a polyvinyl alcohol polymer.

21. A process according to claim 17, where the pigment is a phthalocyanine pigment.

22. A process according to claim 17, wherein said acid photogenerating layer further comprises:

a copper (II) salt and a compound containing secondary hydroxyl groups.

23. A process according to claim 17, wherein said element further comprises:

a barrier layer between said acid photogenerating layer and said conductive layer.

24. A process according to claim 17, wherein said charging is with a positive polarity.

25. A process according to claim 17, wherein said charging is with a negative polarity.

26. A process according to claim 17, wherein said exposing is with near-infrared radiation.

27. A process according to claims 17, wherein said exposing is with near-ultraviolet radiation.

28. A process according to claim 17 further comprising:

cleaning any residual toner particles not transferred to the receiver from said element for each print made.

29. A process according to claim 17, wherein the receiver is a substrate for permanently receiving a toned image as a print.

30. A process according to claim 17, wherein the receiver is means suitable as an optical master or an overhead transparency.

31. A process according to claim 17 further comprising:

heating said element after said printing is completed for all prints to erase the electrostatic conductivity pattern.

* * * * *